US005718172A

United States Patent [19]

Ruckmann et al.

[11] Patent Number: 5,718,172

[45] Date of Patent: Feb. 17, 1998

[54] PRINTING GROUP FOR A COLOR-PRINTING WEB-FED ROTARY PRESS

[75] Inventors: Wolfgang Günter Ruckmann, Würzburg; Martin Heinz Schoeps, Güntersleben, both of Germany

[73] Assignee: Koenig & Bauer-Albert Aktiengesellschaft, Wurzburg, Germany

[21] Appl. No.: 702,553

[22] PCT Filed: Mar. 7, 1995

[86] PCT No.: PCT/DE95/00302

§ 371 Date: Sep. 10, 1996

§ 102(e) Date: Sep. 10, 1996

[87] PCT Pub. No.: WO95/24313

PCT Pub. Date: Sep. 14, 1995

[30] Foreign Application Priority Data

Mar. 10, 1994 [DE] Germany ..... 44 08 026.3

[51] Int. Cl.[6] ..... B41F 7/12; B41F 5/08; B41F 5/16

[52] U.S. Cl. ..... 101/177; 101/180; 101/182; 101/352

[58] Field of Search ..... 101/177, 178, 101/179, 180, 181, 182, 220, 221, 137, 143, 247, 351, 352, 148, 145

[56] References Cited

U.S. PATENT DOCUMENTS

| | | | |
|---|---|---|---|
| 2,557,381 | 6/1951 | Huebner | 101/180 |
| 3,072,050 | 1/1963 | Wolff | 101/177 |
| 3,585,932 | 6/1971 | Granger | 101/350 |
| 3,892,178 | 7/1975 | Staamann . | |
| 3,986,454 | 10/1976 | Granger | 101/216 |
| 4,633,777 | 1/1987 | Germann | 101/177 |
| 4,697,516 | 10/1987 | Rombout . | |

FOREIGN PATENT DOCUMENTS

| | | |
|---|---|---|
| 2 234 089 | 6/1974 | Germany . |
| 35 00 319 | 6/1986 | Germany . |
| 37 02 327 | 8/1988 | Germany . |
| 44 21 437 | 10/1994 | Germany . |
| 502 186 | 3/1971 | Switzerland . |
| 1 288 360 | 9/1972 | United Kingdom . |

*Primary Examiner*—J. Reed Fisher

*Attorney, Agent, or Firm*—Jones, Tullar & Cooper, P.C.

[57] ABSTRACT

A printing system for a multi-color web-fed rotary printing press utilizes a plurality of printing system units that are arranged in a vertical array. Each printing system unit includes a left printing portion, a right printing portion, and a central printing portion. The left and the right portions are supported in left and right shiftable frames which are shiftable horizontally with the respect to a center frame that supports the center portions of the printing system units.

11 Claims, 2 Drawing Sheets

PRINTING GROUP FOR A COLOR-PRINTING WEB-FED ROTARY PRESS

FIELD OF THE INVENTION

The present invention relates to a printing system for a multi-color web-fed rotary printing press for sheet work.

DESCRIPTION OF THE PRIOR ART

An offset web-fed rotary printing press is known from DE-PS 22 34 089, wherein the respective rubber blanket and plate cylinders, which operate against a stationary, seated printing cylinder, are disposed in a displaceable frame in order to separate the printing systems seated above each other for inserting a paper web.

DE-A-37 02 327 discloses a printing system for multi-color sheet work for a rotary printing press. Two printing units are combined in the so-called fold construction into bridge units. Each bridge unit has two inking systems, two printing cylinders and two rubber blanket cylinders, wherein the rubber blanket cylinders are disposed opposite each other. Several bridge units are disposed above each other.

It is disadvantageous in connection with this prior art offset web-fed rotary printing press that it is not suitable for sheet work.

Printing units in an H-shape, disposed in a tower arrangement one on top of the other, for example H on H as a so-called tower of eight, are known from a company brochure of MAN-Roland Druckmaschinen AG, Offenbach, Main (DE), (RA GEO 08.93.1). In this publication, a printing unit in an H-shape respectively consists of two printing units in a U-shape, which are disposed mirror-reversed in respect to each other, and which are also called U-printing units and respectively have four cylinders in a bridge construction.

It is disadvantageous in connection with these printing units disposed on top of each other in tower construction that the paper web to be printed must travel over a comparatively long distance between the printing points, for example between the two printing units in an H-shape placed on top of each other to form a tower of eight, which can lead to registration difficulties. Moreover, the printing systems arranged on top of each other have a great structural height, so that the operators must work on at least two levels of different height. Finally, it is furthermore disadvantageous that the inking systems associated with the printing units at one time have a direction of the ink flow from the top to the bottom and at another time have a direction of ink flow from the bottom to the top in accordance with the mirror-reversed arrangement of the individual U-shaped printing units, which can lead to different inking conditions.

SUMMARY OF THE INVENTION

It is the object of the present invention to create a printing system for a multi-color web-fed rotary printing press for sheet work having a lower structural height.

This object is attained in accordance with the invention by using a printing system for multi-color sheet work for a web-fed rotary printing press in which two printing units are arranged in the so-called bridge construction as bridge units. These units have two inking systems, two printing cylinders and two rubber blanket cylinders which are oriented toward each other. Several of these bridge units are disposed above each other. The bridge units disposed above each other can be separated into left, central and right frame elements that can be placed at horizontal distances from each other.

The following advantages in particular are achieved by means of the invention:

The printing press in accordance with the present invention has a lower structural height and therefore lesser weight which, among other things, reduces the cost for the press foundation. Because of the reduced structural height of the press, it can be operated on only one level. The ink flow in each printing unit always has the same direction, so that the same inking conditions prevail in all of the printing units. Because of the reduced structural height, the amount of waste during start-up and braking operations, for example during printing plate changes, is reduced. Furthermore, because of the reduced structural height, the expenses for a possible enclosure of the press are reduced. Such an enclosure can be of importance for reasons of noise protection or for recovery of heat in connection with air cleaning. Furthermore, the oscillations being created in a printing press are reduced by means of the reduction of the structural height. Moreover, when a wet offset printing process is employed, the action of the so-called fan-out effect is weakened because of the reduced structural height of the printing press. Registration difficulties with conventional printing processes are decreased. Finally, the printing systems of the printing press in accordance with the present invention can also be employed as additional printing systems or as a printing system for a flying printing plate change (imprinter).

Further than that, because of the rapid exchangeability of the printing and rubber blanket cylinders for each printing unit, it is possible to achieve a good format adaptability of the printing press. In the state of rest, a manual change of a finite rubber blanket or of an endless rubber blanket or sleeve is possible because of good accessibility of the press. It is also possible to apply the printing plates to the printing cylinders manually or by means of a printing plate changing device. It is also possible to apply endless rubber blankets or sleeves to the rubber blanket cylinders. This is also possible in the case of a change of the printing plates on the printing cylinder.

It is thus possible to avoid the purchase of expensive installations for a so-called computer-to-press method.

BRIEF DESCRIPTION OF THE DRAWINGS

The present invention will be described in greater detail below by means of several exemplary embodiments. Shown in the associated drawings are in.

DETAILED DESCRIPTION OF THE PREFERRED EMBODIMENT

Figure 1:
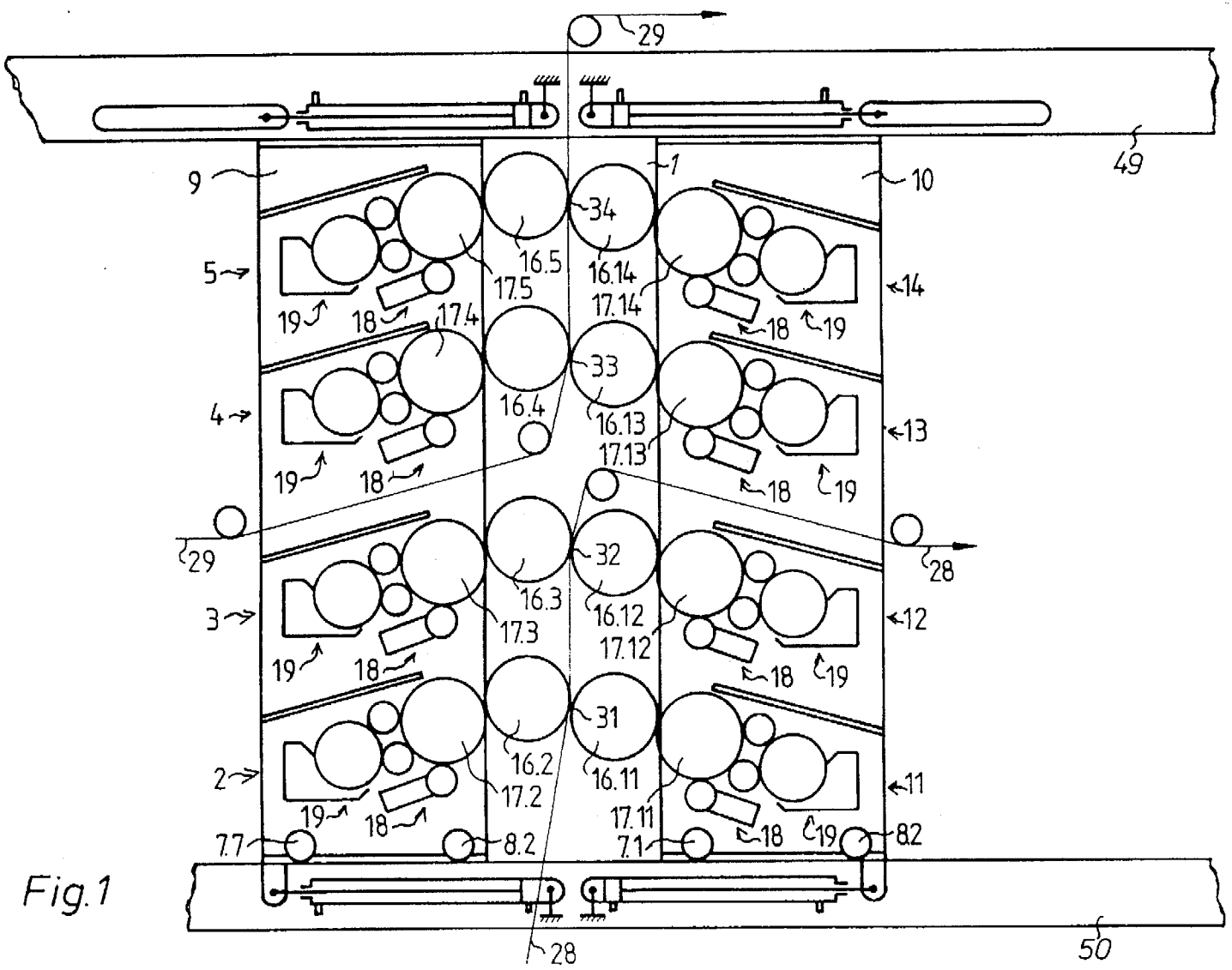
FIG. 1, a schematic lateral view of a printing press in accordance with the invention in the operating position, and FIG. 2, a schematic lateral view in accordance with FIG. 1, but in the rest position.

An upper support 49 and a lower support 50 of a multi-color web-fed rotary printing press, as seen in FIG. 1, receive several printing units which are arranged on top of each other, and which are respectively identified by left printing units 2, 3, 4 and 5, and by right printing units 11, 12, 13, 14. It will be understood that second, parallel extending supports are not represented. A left frame 9, which is displaceable on rollers 7.1, 8.1, and which receives elements of the left printing units 2, 3, 4, 5, is disposed between the supports 49, 50. Furthermore, a right frame 10, which is displaceable on rollers 7.2, 8.2, is disposed between the supports 49, 50, for receiving elements of the right printing units 11, 12, 13, 14. Each printing unit 2 to 5 and 11 to 14 respectively consists of a rubber blanket cylinder 16.2 to 16.5 and 16.11 to 16.14, which cooperates with a respective printing cylinder 17.2 to 17.5 and 17.11 to 17.14. A corresponding number of pairs of rubber blanket cylinders 16.2–16.11; 16.3–16.12; 16.4–16.13; 16.5–16.14, which can be brought in and out of contact with each other, are disposed in a center piece or frame 1, which is at least disposed fixed in place on the lower support 50. Accordingly, all bridge printing units 2, 11; 3, 12; 4, 13; 5, 14 arranged on top of each other, can be separated twice per bridge printing units 2, 11; 3, 12; 4, 13; 5, 14, namely always between the rubber blanket and the printing cylinders: 16.2–17.2; 16.11–17.11 for the bridge printing units 2, 11, and 16.3–17.3; 16.12–17.12 for the bridge printing units 3, 12, and 16.4–17.4; 16.13–17.13 for the bridge printing units 4, 13, and 16.5–17.5; 16.4–17.4 for the bridge printing unit 5, 14. The respective printing cylinders 17 each receive dampening agents from a dampening system, identified as a whole by 18, and ink from an inking system, identified as a whole by 19. For example, the inking system 19 can consist of an inking trough 21 with an inking roller 22 identified at the printing unit 5 in FIG. 2, wherein the inking roller 22 transfers its printing ink by means of ink application rollers 23, 24 to each printing cylinder 17. In place of two ink application rollers 23, 24 of the same size, it is also possible to only employ one smaller or larger ink application roller. In place of an inking trough 21 and an inking roller 22, it is also possible to employ a chamber doctor blade, for example, in connection with a screen roller or anilox roller. However, a conventional inking system can also be employed. Each dampening system 18 be embodied as a spray dampening system consisting of a known spraying device 26, for example a strip with spray nozzles which direct their sprays on a dampening agent application rollers 27. This dampening agent application roller 27 is connected with the printing cylinder 17 identified at the printing unit 4 in FIG. 2.

The printing units 2 to 5 as well as 11 to 14, arranged above each other between the horizontally extending supports 49, 50, are respectively disposed with their rubber blanket cylinders 16.2 16.11; 16.3 16.12; 16.4 16.13; 16.5 16.14 facing each other, so that a paper web 28 or 29 can be printed on both sides. The possible contact points between the rubber blanket cylinders 16 (minus the thickness of the paper web 28 or 29) are identified by 31, 32, 33, 34, as seen in FIG. 1, so that the printing units 2 together with 11, 3 together with 12, 4 together with 13 and 5 together with 14 each form a respective bridge printing unit 2, 11; 3 12; 4 13; 5 14 with each other, or a printing unit in bridge construction, which is embodied in such a way that the rubber blanket cylinders 16.2 16.11; 16.3 16.12; 16.4 16.13; 16.5 16.14 are seated, touching each other in pairs, minus the thickness of the paper web 28 or 29, opposite each other and fixed on the side frame. The left frame 4, which is displaceable between the supports 49, 50 respectively receives the printing cylinder 17.2, 17.3, 17.4, 17.5 as well as a respectively associated dampening system 18 and a respectively associated inking system 19. The right frame 10, which is displaceable between the supports 49 and 50, respectively receives a printing cylinder 17.11, 17.12, 17.13, 17.14 as well as a respectively associated dampening system 18 and a respectively associated inking system 19. The bridge printing units are approximately symmetrical in their arrangement if an imagined straight line is drawn as the center line between the contact points 31 to 34 of the rubber blanket cylinders 16.2–16.11; 16.3–16.12; 16.4–16.13 and 16.5–16.14.

The displaceable frames 9 and 10 can be respectively actuated by means of two double-acting working cylinders 36.1, 37.1, or 36.2, 37.2, for example hydraulic cylinders. In this case the working cylinder 36.1, 36.2, 37.1, 37.2 is seated fixed in place in the side frame, and the end of the piston rod facing away from the cylinder is hingedly connected with the displaceable frame 9 or 10 at its respective top or bottom sides. On its top, the frame 9 and 10 respectively has a guide strip 38, which is guided in a groove 39 located in the upper support 49 that is open at the bottom. For satisfactory smooth movement of the guide strip 38 in the groove 39, the flanks of the guide strip 38 can have recesses for receiving ball bearings, which support the guide strip 38 on the side walls of the groove 39 located in the upper support 49. To achieve great exactness of fit when returning the displaceable frame 9 and 10 from the rest position shown in FIG. 2 into the operating position shown in FIG. 1, the frame 1 has a plurality of pins 42.1, 42.2 or 43.1, 43.2 respectively on its perpendicularly extending closure edge 41.1 or 41.2, which project past the closure edge 41.1, 41.2, which engage blind bores 46.1, 46.2 or 47.1, 47.2 in a perpendicularly extending closure edge 44.1 or 44.2 of the frame 9 or 10, as is only represented in FIG. 2. In the operating position shown in FIG. 1, the displaceable frame 9 or 10 is protected against accidental displacement by means of a mechanically operating locking device, identified as a whole by 48.1 or 48.2 as again is only represented in FIG. 2. The locking device 48.1 or 48.2 consists of a threaded bush, seated fixed in place on the frame, which forms an interlocking connection with a threaded spindle, seated fixed in place on the center piece 1, when the frame 9, 10 is closed. In the process, the threaded spindle is moved in the direction of the left center piece 1 by means of a motor-driven threaded sleeve.

During a stoppage of the printing press, it is possible to manually change the printing plates on the printing cylinders 17 by means of an operator.

It is furthermore possible to change the printing plates on the printing cylinder 17.2 to 17.5 and 17.11 to 17.14 by means of a printing plate changing device, identified as a whole by 51 and respectively associated with each printing unit 2 to 5 and 11 to 14. This printing plate changing device, which is not represented in detail can consist of two linear guides, disposed fixed in place on the center piece or at the frame at a distance of at least one printing cylinder width, on which both ends of a gripper crosspiece are guided. The gripper crosspiece extends in an axis-parallel direction with respect to the respective printing cylinder 17 and supports a number of suction devices, by means of which a printing plate, which is in a standby position on both sides of support rails fixed in place on the frame, can be picked up and suspended with its front bevel in a suspension slit, not shown, of the printing cylinder 17 by means of the movement of the gripper crosspiece on the linear guides. The printing plate can either be clamped on both sides in suspension slits (known from DE G 92 18 389.1, for example), or on only one side, wherein the printing plate 57 is then held by means of magnets, not shown, inserted into the surface of the printing cylinder 17. The linear guides can be embodied as threaded spindles, on which the gripper crosspiece is moved by means of threaded sleeves turned by an electric motor.

The control of the rotating movement of the printing cylinder and synchronization of the insertion and removal of the printing plate is known from DE 39 40 796 C2. A sheet metal deposit plate, fixed in place in the side frames, and as wide as the printing cylinder, extends parallel with, and below, the support rails for receiving the printing plates, not shown, taken off the printing cylinder. It is also possible to use support rails, fixed in place on the frame, in place of the sheet metal deposit plate. The printing plate changing device 51 is only symbolically indicated in FIGS. 1 and 2.

It is possible with the printing system in accordance with the present invention, to exchange the printing cylinders 17.2 to 17.5 and 17.11 to 17.14, as well as the associated rubber blanket cylinders 16.2 to 16.5 and 16.11 to 16.14, for those with a larger diameter. This can take place manually by means of the operators, which change the above mentioned cylinders when the printing system is in a state of rest, as shown in FIG. 2 and when a service aisle 52, 53 of a usable width "a" or "b" is created between the stationary, perpendicularly extending center piece 1, in which the rubber blanket cylinders 16 are seated, and the displaceable frames 9, 10.

Figure 2:
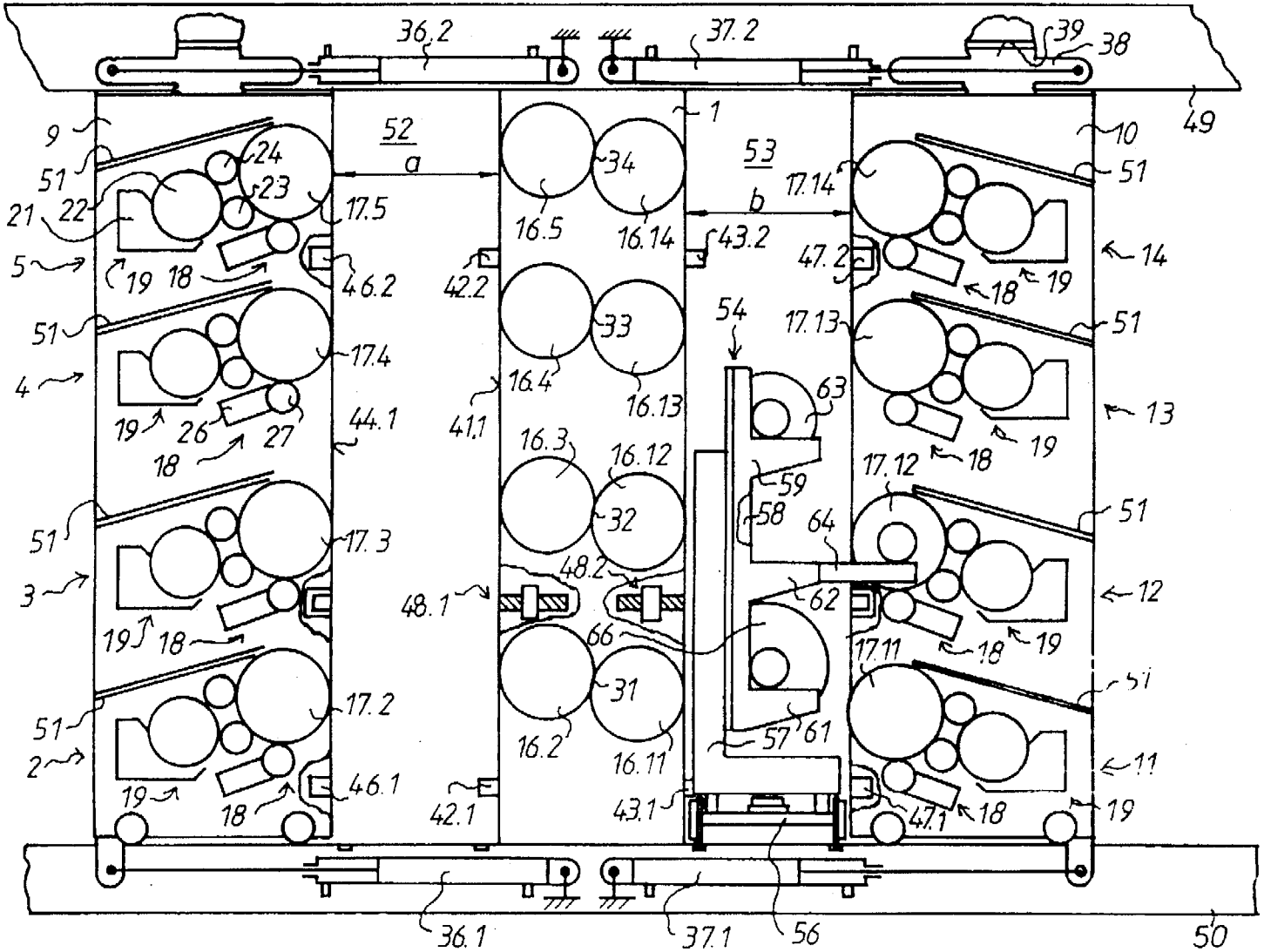

The various blanket and printing cylinders 16, 17 can also be changed by means of a lifting and transporting arrangement, identified as a whole by 54, and shown in FIG. 2, and which consists of a carriage 56 displaceable on rails in the service aisles 52, 53, which has two separately height-adjustable lifting devices 58, 59 on a frame 57 for receiving the journals of the cylinders 16, 17. The lifting devices 58, 59 respectively have three horizontally extending support arms 61, 62, 63 for receiving the journals of the cylinders 16, 17. The support arms of the second lifting device 58 are not completely represented in FIG. 2. Each support arm 61 to 63 has an extendible cross arm 64, which extends the support arm 61 to 63 in the horizontal direction, and on which a cylinder, for example the printing cylinder 17.12 from the printing unit 12, as shown in FIG. 2, can be exchanged, for example for a printing cylinder 66 of larger diameter on the support arms 61 of the lifting and transporting arrangement 54. Here the cylinder seats, fixed in place in the side frame, are embodied in a known style, for example with roller locks. Accordingly, all cylinders 16, 17 can also be sequentially exchanged by means of the lifting and transporting arrangement 54. The journals of the rubber blanket cylinders 16.2 to 16.5 and 16.11 to 16.14, seated fixed in place on the side frame, are seated in displaceable seating unit, not shown.

To match the inking system 19 of each printing unit 2 to 5 and 11 to 14 to the increased diameter of the respective printing cylinder 17, the inking system 19 can be disposed by means of a displaceable rack in the frame 9, 10 in the direction remote from the printing cylinder, such as is shown in DE-PS 22 34 089 in connection with plate and rubber blanket cylinders. The dampening system 18 can be displaced in the same way, i.e. in a direction remote from the printing cylinder.

Since, in case of an exchange of the cylinders 16, 17 for those of a larger diameter, the displaceable frames 9, 10 no longer touch the closure edges 41.1 and 41.2 of the vertically extending side or center frame 1 with their closure edges 44.1, 44.2, spacers are disposed on the above mentioned closure edges at the level of the pins 42.1, 42.2; 43.1, 43.2, which secure the displaceable frames 9, 10 to the vertically extending side or center frame 1. The locking devices 48.1, 48.2 are also of such a size that a longitudinal gap present between the frames 9, 10 and the vertical side or center frame 1 in the operating state, can be bridged. This longitudinal gap can be respectively covered by a sliding door, for example, to guard against unintended touching.

For the case that the rubber blanket cylinders 16.2 to 16.5 and 16.11 to 16.14, or only some of them, are intended to be covered by an endless rubber blanket, such as a known rubber blanket tube or "sleeve", the above mentioned rubber blanket cylinders can be removed from their seats by means of the lifting and transporting arrangement 54 and kept in place by a clamping device located on the rear, second lifting device 58, which acts on a journal (see DE 35 00 319 C2). After lowering and, if required, pivoting the front lifting device 59, the entire circumference of a rubber blanket cylinder 17 is accessible for receiving a fresh rubber blanket tube. Mounting of the rubber blanket cylinder 17 takes place in a reverse sequence. A change of the printing plates of one or several printing cylinders 16.2 to 16.5 and 16.11 to 16.14 can take place in the same way in case that processed aluminum tubes or "sleeves" are intended to be used as formes in place of conventional printing plates.

It is, in addition, necessary, during a change of the printing cylinder 17 for larger ones, to respectively adjust the printing plate changing devices 51 in such a way that they rest with the end near the cylinder on the now changed diameter of the printing cylinder 17.

It is possible to use cylinders produced in lightweight construction as printing cylinders 17 or rubber blanket cylinders 16, such as those described in DE-G 93 18 285.6.

It is obvious that, for example, second supports as well as a second displaceable frame are required for the functioning of the printing system, the same as second working cylinders for displacing the above mentioned frames, as well as associated locking devices and so forth.

The rubber blanket cylinders 16 and printing cylinders 17 of each bridge printing unit 2, 11; 3, 12; 4, 13 or 5, 14 can respectively be provided with separate drive motors. By means of this, it becomes possible for an uncoupled printing cylinder 17 to be provided with fresh printing plates while the printing system is in operation (imprinter).

A total structural height of the printing system in accordance with the invention with four bridge units 2, 11; 3, 12; 4, 13 or 5, 14 can be between eight and fifteen times the diameter of a printing cylinder 17, wherein the diameter relates to the so-called "Berlin format". Accordingly, a structural height of a printing system 2, 3, 4, 5, 11, 12, 13 or 14 relates to twice to 3.75 times the diameter of a printing cylinder 17 in the "Berlin format". The diameter of a printing cylinder 17 in the "Berlin format" is approximately 300 millimeters.

Modified dampening systems and conventional inking systems can also be employed in place of the dampening systems 18 or the short inking systems 19.

In this case, the conventional inking system can consist of an inking trough with an inking ductor and a coating roller, which are followed by two ink transfer rollers, between which ink distributing rollers are placed. The latter of the two ink distributing rollers is connected via two ink application rollers, which are arranged parallel with each other, with the printing cylinder. The modified dampening system can consist of a spray dampening system with a moisture distribution cylinder and an associated smoothing roller, wherein the moisture distribution cylinder is connected via the dampening agent application roller with the printing cylinder 17.

It is also possible to dispose the center piece 1 displaceably between the supports 49, 50 in a manner analogously to that of the frame element 9, 10. The multi-color web-fed rotary printing press in accordance with the invention can be particularly employed in connection with the following printing processes: for conventional offset printing and for anilox offset printing, for indirect letterpress printing and also for waterless offset printing.

While a preferred embodiment of a printing group for a color-printing web-fed rotary press in accordance with the present invention have been set forth fully and completely hereinabove, it will be obvious to one of skill in the art that a number of changes in, for example, the web being printed, the ink being used, the overall size of the press and the like may be made without departing from the true spirit and scope of the present invention which is accordingly to be limited only by the following claims.

We claim:

1. A printing system for multi-color sheet work for a web-fed rotary printing press comprising:

a plurality of printing units arranged in bridge construction, each of said plurality of printing units having a first inking system and a second inking system, a first printing cylinder and a second printing cylinder and a first rubber blanket cylinder and a second rubber blanket cylinder, said first and second rubber blanket cylinders in each of said printing units being engageable with each other to print a web passing vertically therebetween, said several printing units in said bridge construction being disposed one above the other, each of said printing units being separable into a first part including said first inking systems and said first printing cylinders, a second part including said second inking systems and said second printing cylinders, and a third part including said first and second rubber blanket cylinders;

a first frame section, said first inking systems and said first printing cylinders being mounted on said first frame section;

a second frame section, said second inking systems and said second printing cylinders being mounted on said second frame section;

a center frame section, said first and second rubber blanket cylinders being mounted on said center frame section, said center frame section being fixed in place intermediate said first and second frame sections; and means to support each of said first and second frame sections for movement with respect to each other and with respect to said center frame section toward and away from said center frame section.

2. The printing system of claim 1 further including means to lock said first, second and center frame sections together in an operating state.

3. The printing system of claim 1 further including a dampening system associated with each of said printing units.

4. The printing system of claim 1 further including a rack frame for support of each of said first and second inking systems in each of said printing units.

5. The printing system of claim 3 further including a rack frame for support of said dampening system.

6. The printing system of claim 1 further including means for releasably supporting each of said rubber blanket cylinders in said center frame section whereby rubber blanket cylinders of different diameters can be supported in said center frame section.

7. The printing system of claim 1 further including means for releasably supporting said first and second printing cylinders in said first and second frame sections whereby printing cylinders of different diameters can be supported in said first and second frame sections.

8. The printing system of claim 1 wherein each of said first and second inking systems is an anilox short inking system.

9. The printing system of claim 1 wherein each of said first and second inking systems is a conventional inking system.

10. The printing system of claim 1 wherein said first and second frame sections are movable away from said center section a distance sufficient to afford access to said first and second printing cylinders and said first and second rubber blanket cylinders.

11. The printing system of claim 1 wherein each of said first and second rubber blanket cylinders is displaceably supported in said center frame sections.

* * * * *